US012349775B1

(12) United States Patent
Hedaya et al.

(10) Patent No.: US 12,349,775 B1
(45) Date of Patent: Jul. 8, 2025

(54) BAG EXPANDERS AND METHOD

(71) Applicants: Revolution Designs LLC, Brooklyn, NY (US); Solomon Hedaya, Brooklyn, NY (US)

(72) Inventors: Solomon Hedaya, Brooklyn, NY (US); Maurice Hedaya, Brooklyn, NY (US)

(73) Assignee: Revolution Designs LLC, Brooklyn, NY (US)

( * ) Notice: Subject to any disclaimer, the term of this patent is extended or adjusted under 35 U.S.C. 154(b) by 0 days.

(21) Appl. No.: 18/146,976

(22) Filed: Dec. 27, 2022

Related U.S. Application Data

(60) Provisional application No. 63/266,072, filed on Dec. 28, 2021.

(51) Int. Cl.
*A45C 13/00* (2006.01)

(52) U.S. Cl.
CPC ..... *A45C 13/004* (2013.01)

(58) Field of Classification Search
CPC ..... A45C 13/004
USPC ..... 383/33, 35; 190/106
See application file for complete search history.

(56) References Cited

U.S. PATENT DOCUMENTS

| | | | | |
|---|---|---|---|---|
| 2,795,259 | A * | 6/1957 | Nash | A45C 1/02 150/900 |
| 4,077,451 | A | 3/1978 | Zoland | |
| 6,550,967 | B2 | 4/2003 | Hedaya | |
| 6,698,927 | B2 * | 3/2004 | Hedaya | B65D 33/00 383/127 |
| 9,930,949 | B2 | 4/2018 | Zoland | |
| 10,292,471 | B2 | 5/2019 | Zoland | |
| 2006/0233472 | A1 * | 10/2006 | Encarnacion | A45C 13/02 383/127 |
| 2008/0137999 | A1 | 6/2008 | Chi | |
| 2010/0142860 | A1 * | 6/2010 | Minicozzi | B65F 1/1415 383/33 |
| 2016/0331095 | A1 * | 11/2016 | Zoland | A45C 13/004 |

* cited by examiner

*Primary Examiner* — Jes F Pascua
*Assistant Examiner* — Nina K Attel
(74) *Attorney, Agent, or Firm* — Fox Rothschild LLP

(57) ABSTRACT

A bag expander, comprising a first wall portion, a second wall portion, a bridge coupling the first and second wall portions together, wherein the first and second wall portions are rotatable about the bridge to lie along a substantially same plane, and an expansion mechanism secured to the bridge, wherein the expansion mechanism is configured to bias the first wall and second wall portions from a collapsed configuration to an expanded configuration.

14 Claims, 13 Drawing Sheets

BAG EXPANDERS AND METHOD

CROSS-REFERENCES TO RELATED APPLICATIONS

This application claims the benefit of priority under 35 U.S.C. § 119 (e) to U.S. Provisional Patent Application No. 63/266,072, filed on Dec. 28, 2021, the entire contents of which is herein incorporated by reference.

BACKGROUND OF THE INVENTION

Bag expanders are used to provide certain bag articles (e.g., backpacks, purses, diaper bag, duffle bag or the like) with an appearance of being filled. This can be valuable to retailers in displaying and marketing their products in their stores. The industry standard has been to ship the bag articles from Asia to the U.S.A. stuffed with the bag expander, or ship the expander flat to be stuffed in the U.S.A., thus minimizing cost of product with usage of the expander. In turn, the stuffed bag article is shipped to the retailer a stuffed product. The bag expander minimizes freight costs and stuffing costs in USA This filled appearance allows a viewer to determine what the article looks like when the article is in use and filled with items, and also providing a more appeal appearance to the customer. Other structural bag expanders have been developed in the past. However, traditional bag expanders use bands that pull the bag expanders into an expanded form, expands in a manner that does not sufficiently provide the bag article with a filled appearance, or for example, other known expanders are structured in a manner that do not allow for mass transportation or use. Improvements related to, among other things, ease and cost of manufacturing, use, and installation can be provide significant benefits in this field and are desired.

The present disclosure provides for a bag expander that allows for easier mass transportation while having an expanded configuration to provide a bag article with a filled appearance.

BRIEF SUMMARY OF THE INVENTION

The present disclosure provides for a bag expander to be inserted in bag articles, and methods of use and manufacturing thereof.

One aspect of the disclosure provides for a bag expander, comprising a first wall portion, a second wall portion, a bridge coupling the first and second wall portions together, wherein the first and second wall portions are rotatable about the bridge to lie along a substantially same plane, and an expansion mechanism secured to the bridge, wherein the expansion mechanism is configured to bias the first wall and second wall portions from a collapsed configuration to an expanded configuration. The bridge can include a first and second portion, and can define a hinge area, the first portion being rotatable to the second portion along the hinge area. The first and second portions can rotate about a first axis, and at least one of the first and second wall portions can rotate about a second axis substantially parallel to the first axis. The expansion mechanism can have a central portion engaged to the hinge area. The bridge can be monolithic. The first and second wall portions and the bridge can be monolithic. The expansion mechanism can be a torsion spring. At least one of the first and second wall portions can define a foldable area such that at least a portion of the at least one of the first and second wall portions can be folded to define an edge along the foldable area. The at least one of the first and second wall portions can include a line of perforations, the foldable area being defined by the line of perforations. A bag article can comprise a housing and the bag expander as disclosed received in the body.

Another aspect of the disclosure provides for a bag expander, comprising a first wall portion, a second wall portion, a bridge coupling the first and second wall portions together, wherein the first and second wall portions can hinge about the bridge to lie along a substantially same plane, and an expansion mechanism secured to the bridge, wherein, in a collapsed configuration, the first and second wall portions are a first distance from each other, and, in an expanded configuration, the first and second wall portions are a second distance from each other, the second distance being greater than the first distance. The bridge can include a first and second portion, and can define a hinge area, the first portion being rotatable to the second portion along the hinge area. The first and second portions can rotate about a first axis, and at least one of the first and second wall portions can rotate about a second axis substantially parallel to the first axis. The expansion mechanism can have a central portion engaged to the hinge area. The bridge can be monolithic. The first and second wall portions and the bridge can be monolithic. The expansion mechanism can be a torsion spring. At least one of the first and second wall portions can define a foldable area such that at least a portion of the at least one of the first and second wall portions can be folded to define an edge along the foldable area. The at least one of the first and second wall portions can include a line of perforations, the foldable area being defined by the line of perforations. A bag article can comprise a housing and the bag expander as disclosed received in the body.

BRIEF DESCRIPTION OF THE DRAWINGS

The foregoing and other features of the present disclosure will become more fully apparent from the following description and appended claims, taken in conjunction with the accompanying drawings. Understanding that these drawings depict only several examples in accordance with the disclosure and are, therefore, not to be considered limiting of its scope, the disclosure will be described with additional specificity and detail through use of the accompanying drawings, in which:

DETAILED DESCRIPTION OF THE INVENTION

Figure 7:
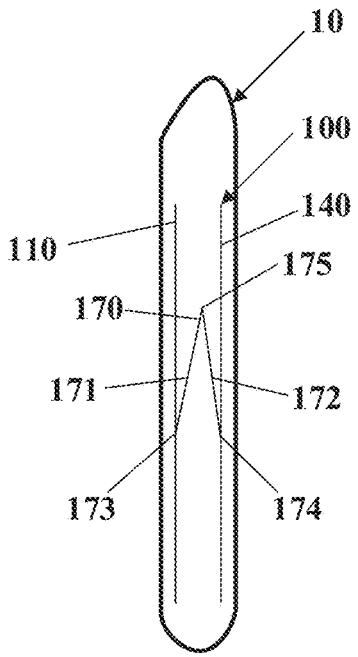
FIG. 7 is a cross-sectional side view of the bag expander of FIGS. 1-6 inserted within a bag article in a collapsed configuration.
Figure 8:
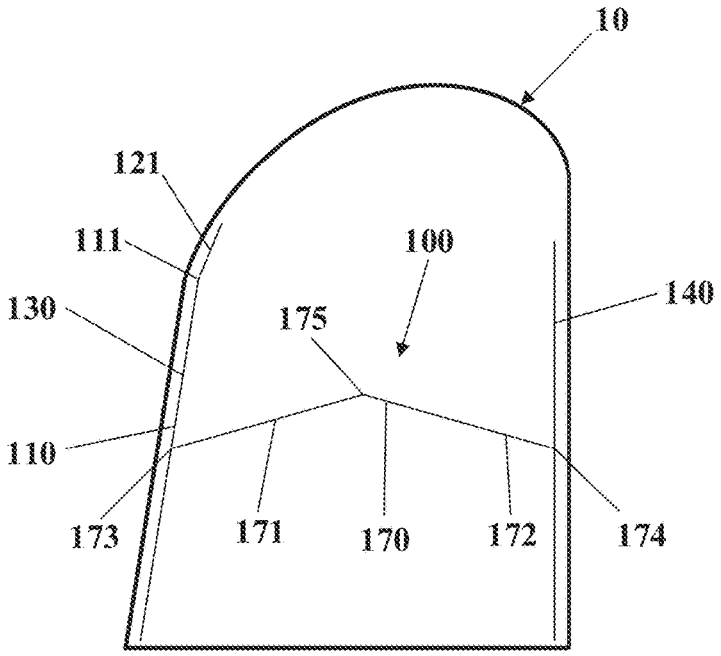
FIG. 8 is a cross-sectional side view of the bag expander of FIGS. 1-6 inserted within the bag article of FIG. 7 in an expanded configuration.
Figure 9:
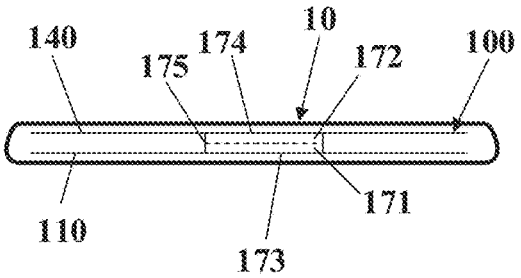
FIG. 9 is a cross-sectional top view of the bag expander of FIGS. 1-6 inserted within the bag article of FIG. 7 in a collapsed configuration.
Figure 10:
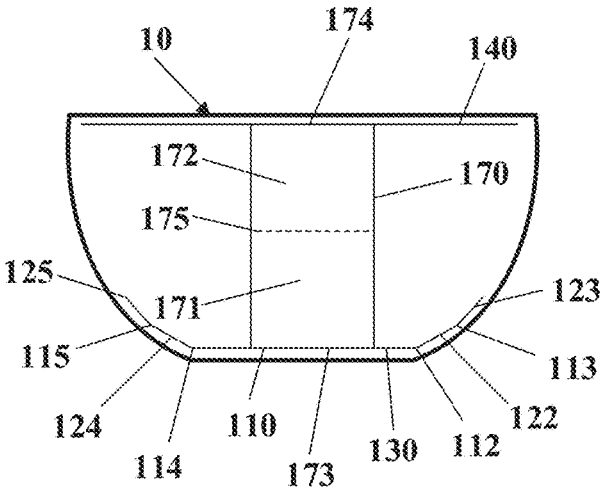
FIG. 10 is a cross-sectional top view of the bag expander of FIGS. 1-6 inserted within the bag article of FIG. 7 in an expanded configuration.

The present disclosure is directed to bag expanders for use with bag articles. In particular, the bag expanders can be inserted within the housing of bag articles while in a collapsed configuration, as shown in FIGS. 7 and 9. While in this collapsed configuration, the bag expander is expandable so that, the bag expander can later expand from the collapsed configuration to an expanded configuration, as shown in FIGS. 8 and 10. This expansion can be caused by an expansion mechanism (e.g., a spring, a pair of magnets, a compressible and elastomeric object, or the like) that biases the bag expander from the collapsed configuration to the expanded configuration. When the bag expander is in the expanded configuration within a bag article, the bag expander expands the bag article such that the bag article has an appearance of being filled.

Figure 11:
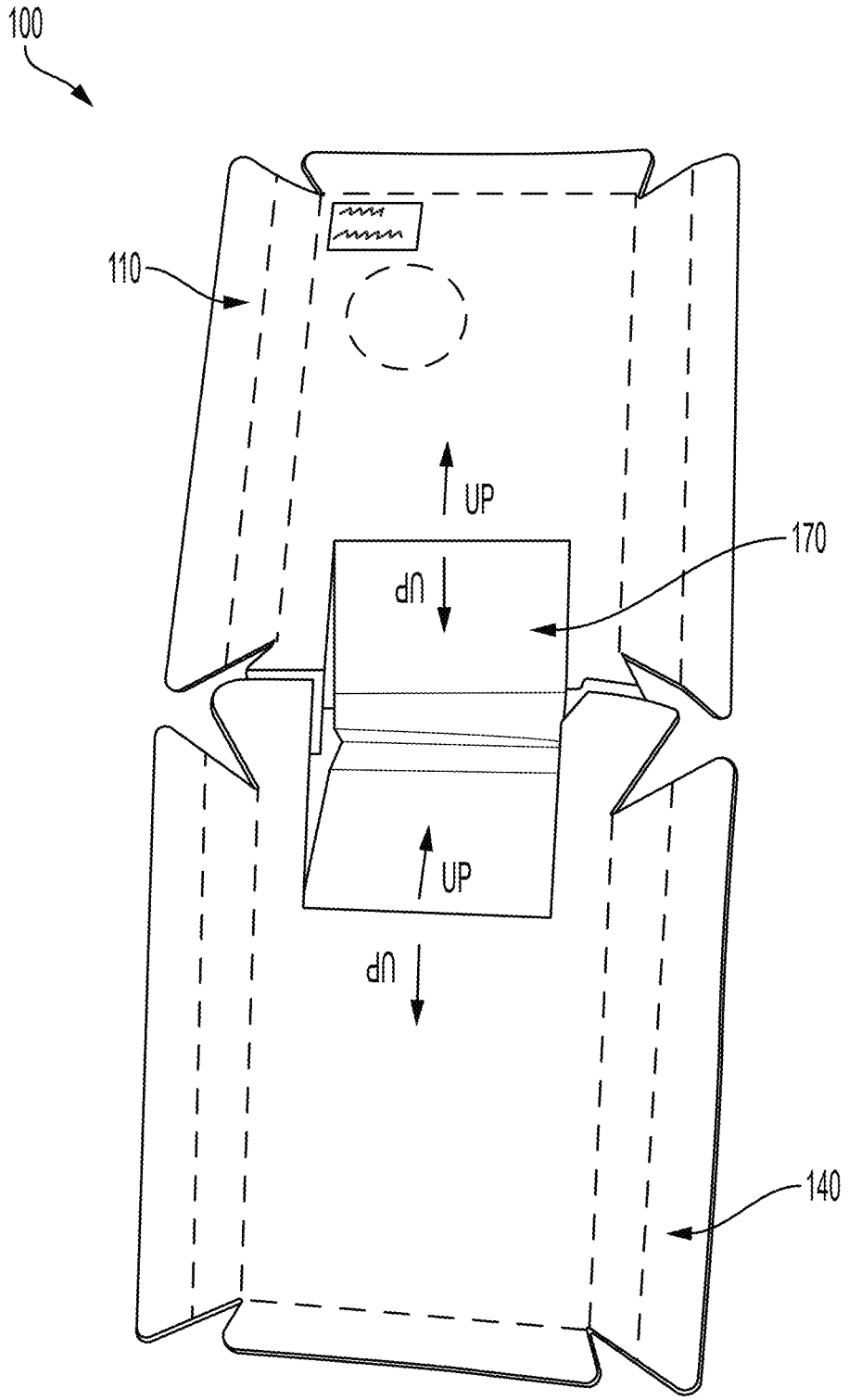
FIG. 11 is a top view of the bag expander of FIGS. 1-6 in an unassembled configuration.
Figure 12:
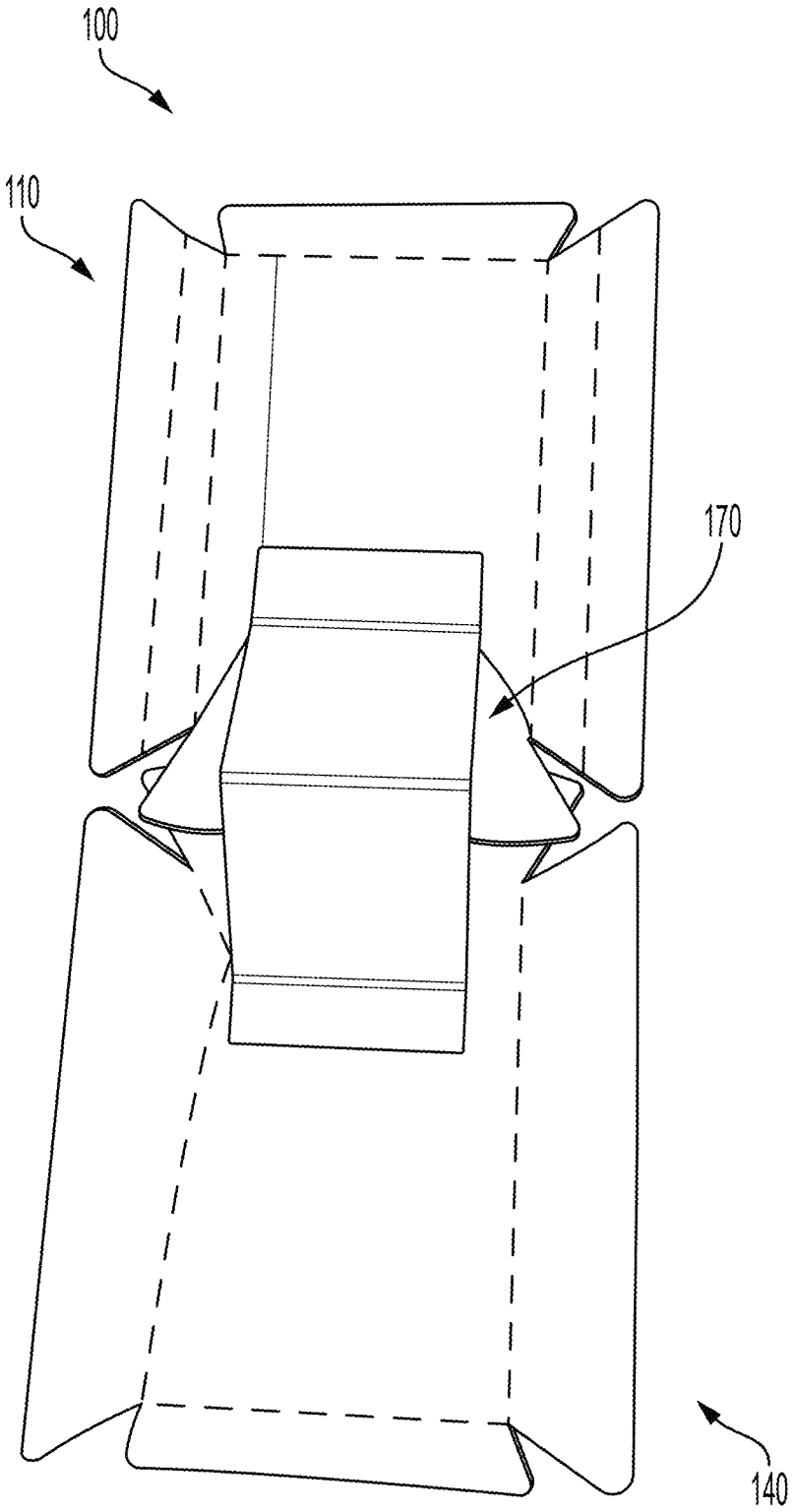
FIG. 12 is a bottom view of the bag expander of FIGS. 1-6 in an unassembled configuration.
Figure 22:
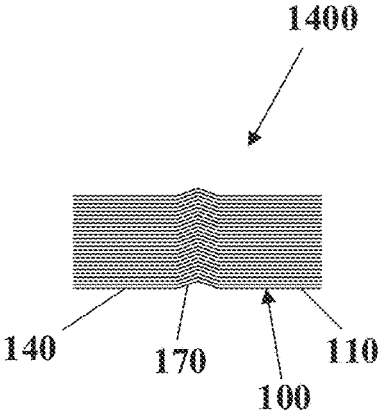
FIG. 22 is a side view of a stack of the bag expanders of FIGS. 1-6 in an unassembled configuration.

The bag expander also has an assembled configuration and an unassembled configuration. In the assembled configuration, the bag expander is in a collapsed or expanded configuration, as described above, and is ready to be, or already is, inserted within a bag article. In the unassembled configuration, the bag expander is laid out to be substantially planar, even with the biasing force provided by the expansion mechanism, as shown in FIGS. 11-12. In this unassembled configuration, the bag expander can be stacked together to form a stack of bag expanders that is readily transportable to be shipped to an end user (such as the retailer), as shown in FIG. 22.

Figure 1:
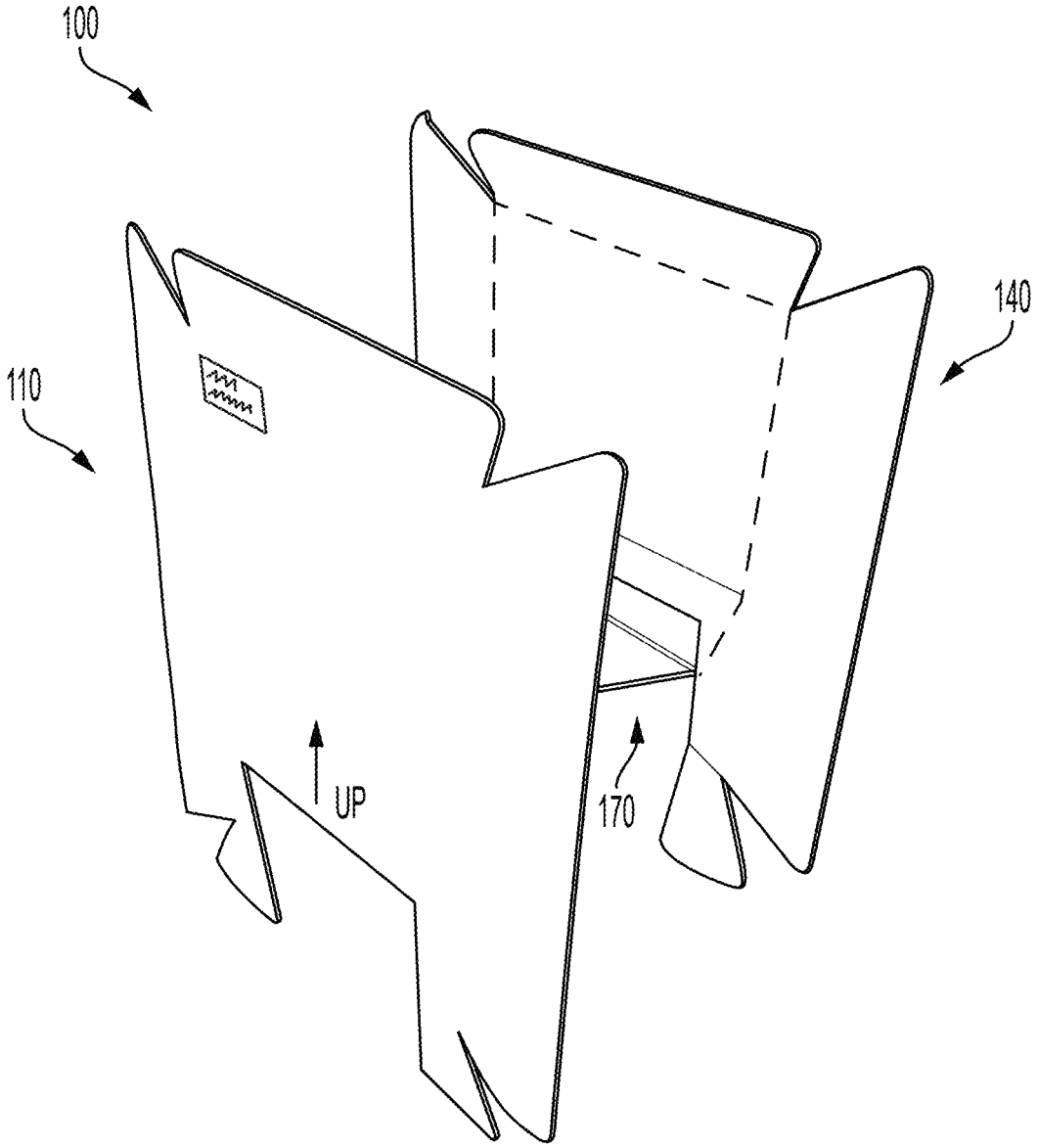
FIG. 1 is a top perspective view of a bag expander according to one aspect of the disclosure.

FIGS. 1-6 depict an example bag expander 100 in an assembled and expanded configuration. The bag expander 100 includes a first wall portion 110, a second wall portion 140, and a bridge 170. With reference to FIG. 1, the first wall portion 110 is substantially planar and includes four edges: a top edge 101, a right side edge 102, a left side edge 103, and a bottom edge 104. The edges 101, 102, 103, 104 defines the first wall portion 110 to be a substantially rectangular shape however, in other embodiments, the first wall portion can have an alternative shape, such as circular, triangular, or other polygonal shape.

The wall portions 110, 140 and the bridge 170 of the bag expander 100 can be made of a cellulose material, such as recycled cardboard. For example, in this context, at least 90% of the wall portions 110, 140 and the bridge 170 of the bag expander 100 can be made of cardboard. However, such portions of the bag expander can be made of other materials, such as with plastic, metal, other material with rigid qualities, or a combination thereof. The rigidity of the material from which the wall portions and the bridge of the expander (the body of the expander) is made can be that of corrugated cardboard having a particular grade of rigidity, such as flute sizes ranging from A-Flute to F-Flute. However, other embodiments are contemplated, such as double or triple wall flutes.

The first wall portion 110 includes a main portion 130 and defines foldable areas 111, 112, 113, 114, 115. The foldable areas 111, 112, 113, 114, 115 allow for which portions of the first wall portion 110 can fold along, relative to the main portion 130, to change the shape and dimension of the first wall portion 110. In particular, a top portion 121 can fold along the foldable area 111 relative to the main portion 130. An outer right side portion 123 can fold along foldable area 113 relative to an inner right side portion 122 while the inner right side portion 122 can fold along foldable area 112 relative to main portion 130. An outer left side portion 125 can fold along foldable area 115 relative to an inner left side portion 124 while the inner left side portion 124 can fold along foldable area 114 relative to main portion 130. In this manner, the foldable areas 111, 112, 113, 114, 115 can define an edge of the first wall portion 110 when one or more of the adjacent portions 121, 122, 123, 124, 125 are folded.

For example, to reduce a height of the first wall portion 110, top portion 121 can be folded along the foldable area 111. In another example, the width of the first wall portion 110 can be reduced along one or both lateral sides by folding one of the outer side portions 123, 125 along the foldable areas 113, 115 and/or the inner side portions 122, 124 along the foldable areas 112, 114.

Such folding can be particularly helpful as, when the first wall portion 110 abuts against an inner surface of the housing of a bag article, an expanded bag expander 100 can expand the bag article to seemingly have a more rounded and natural shape. For example, with reference to FIGS. 7-10, the bag expander 100 can be expanded in a bag 10 such that the portions 121, 122, 123, 124, 125 are folded along foldable areas 111, 112, 113, 114, 115 to allow for the bag 10 to have a rounded shape. However, in other embodiments, the first wall portion can have no foldable areas so that the first wall portion is entirely rigid and, when the bag expander is in its expanded form, the first wall portion can abut against an inner surface of the housing of a bag to expand the bag to have sharp corners. In yet further embodiments, the foldable areas 111, 112, 113, 114, 115 can additionally or alternatively be weakened areas along which the portions 121, 122, 123, 124, 125, 130 of the first wall portion 110 can be torn, cut, or otherwise separated from each other to allow for a change in size and structure of the first wall portion 110.

Figure 2:
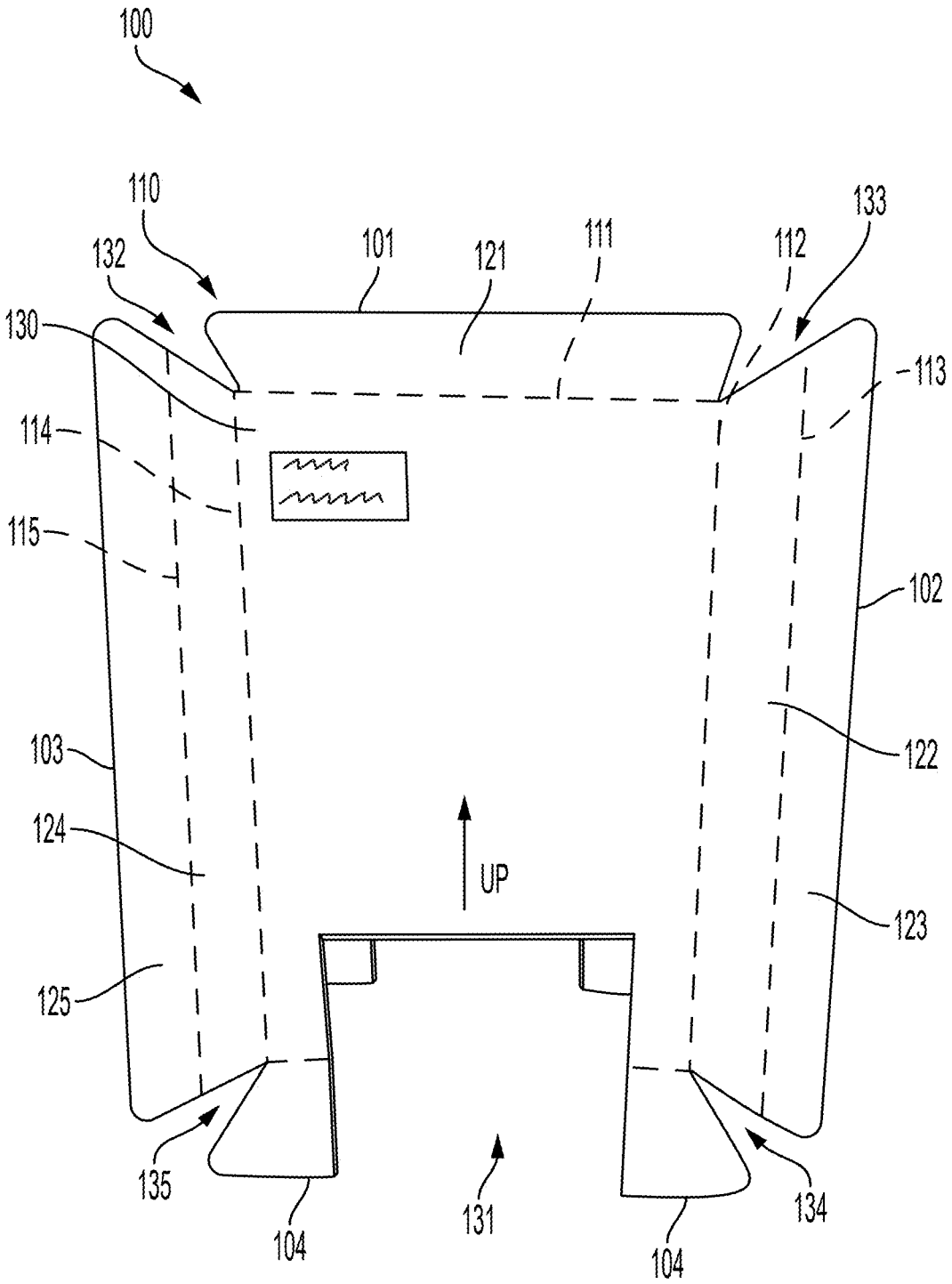
FIG. 2 is a front view of the bag expander of FIG. 1.

FIG. 2 depicts the foldable areas 111, 112, 113, 114, 115 as being substantially parallel to their corresponding edges 101, 102, 103. However, in other embodiments, the foldable areas can be transverse to the edges of the first wall portion. In alternative embodiments, there may be any number of foldable areas and a corresponding number of side portions. In a further alternative embodiment, there may be a differing amount of foldable areas along one side of the first wall portion (e.g., the left side) as there are on another side (e.g., the right side). In a yet further alternative embodiment, there can be one or more foldable areas and foldable portions to fold along those foldable areas towards a bottom edge of the first wall portion. In yet other embodiments, the foldable areas are not straight lines and, rather, can be curved or angled. Such variations in the foldable areas allow for the first wall portion to be manufactured to provide any type of expansion shape specific to any bag article.

The foldable areas 111, 112, 113, 114, 115 are a line of perforations through the first wall portion 110. FIG. 2 depicts such perforations are depicted as longitudinal slits.

However, in other embodiments, the foldable areas can be other perforations, such as circular dots, a perforated line of alternating shapes, a single slit that cuts partly through the thickness of the first wall portion, or other perforation structures to allow folding.

The first wall portion 110 defines a plurality of corner cutouts 132, 133, 134, 135 such that, when one or more of the portions 121, 122, 123, 124, 125 fold along the foldable areas 111, 112, 113, 114, 115, the sides of those portions 121, 122, 123, 124, 125 do not interfere with an adjacent side of an adjacent portion 121, 122, 123, 124, 125 during the folding.

The main portion 130 defines a bottom cutout 131 toward a bottom edge 104. The size and shape of the bottom cutout 131 corresponds to a portion of bridge 170, such as first bridge portion 171, as shown in FIG. 3.

As depicted in FIGS. 1-6, the structure of the second wall portion 140 substantially mirrors that of the first wall portion 110. However, in alternative embodiments, one of the first wall portion and the second wall portion can have a different shape or structure to each other to provide a customized shape for a particular bag article. For example, the first wall portion can have a smaller height than the second wall portion to allow for the bag article to have a sloped appearance after the bag expander is expanded.

Figure 3:
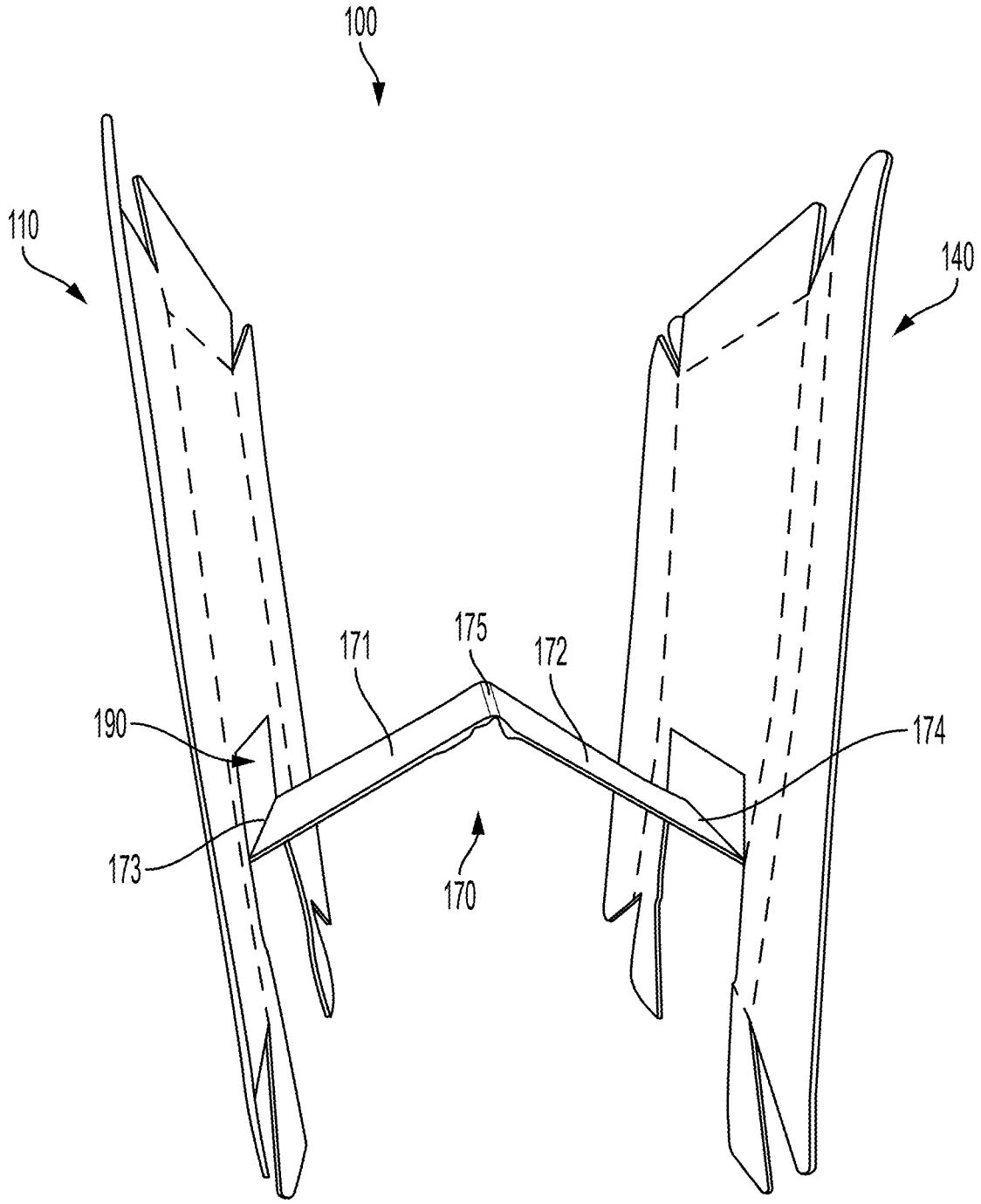
FIG. 3 is a side view of the bag expander of FIG. 1.
Figure 4:
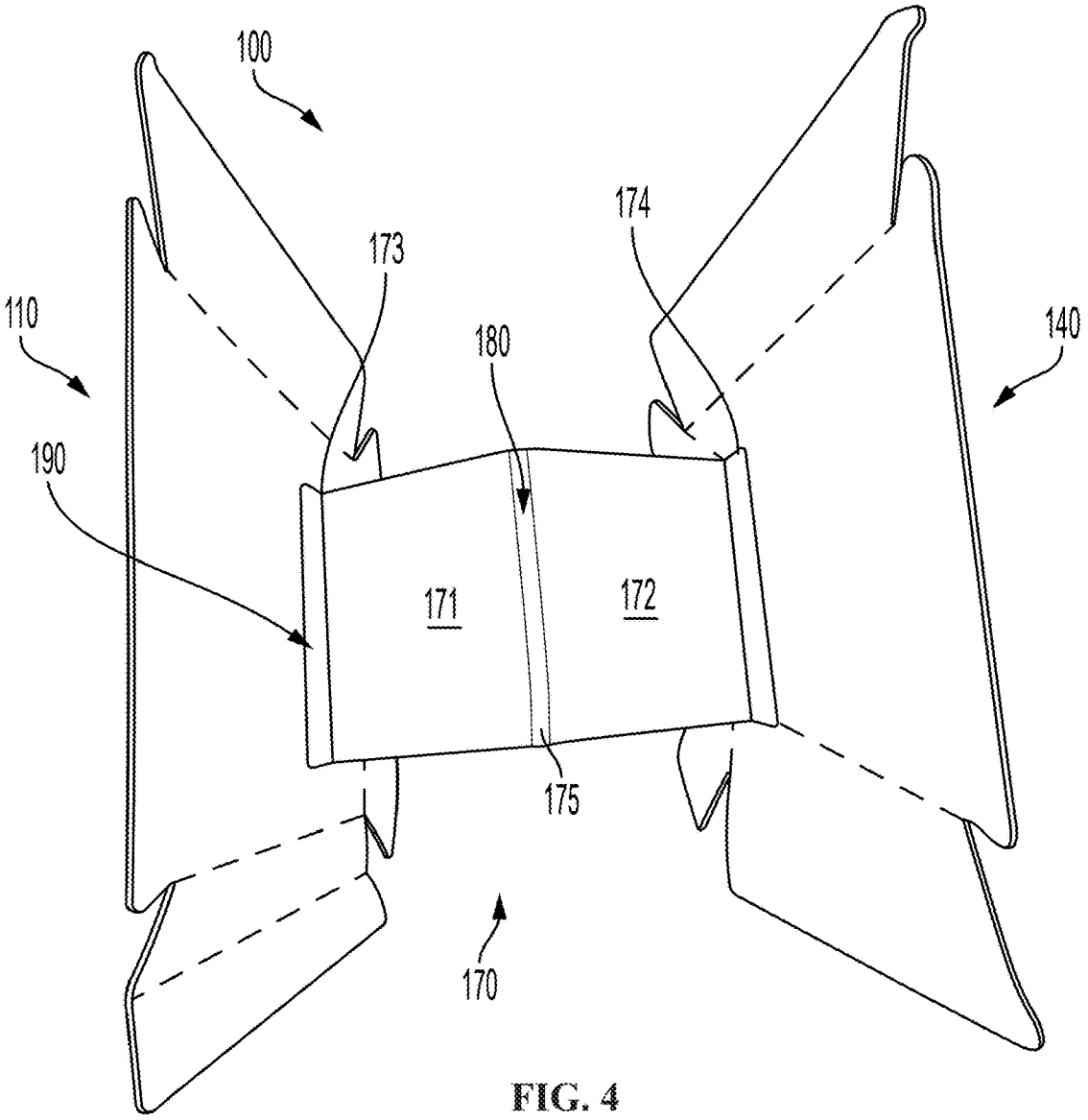
FIG. 4 is a top view of the bag expander of FIG. 1.

With reference to FIGS. 3-4, the bridge 170 couples the first wall portion 110 to the second wall portion 140. The bridge includes a first bridge portion 171 and a second bridge portion 172. The bridge 170 defines a bridge hinge area 175 along which the bridge portions 171, 172 can rotate about. Bridge portions 171, 172 can rotate about an axis defined by the bridge hinge area 175 that is substantially parallel to an axis defined by the hinge areas 173, 174 that wall portions 110, 140 can rotate about such that the axis defined by hinge areas 173, 174 is not transverse to the axis defined by the bridge hinger area 175 by 5%. As shown, the bridge hinge area 175 extends across a width of the bridge 170. The bridge hinge area 175 can be a fold line formed along the bridge 170, such as being a monolithic structure (e.g., formed as one piece) with a fold line caused through a pressure indentation or as perforations cut along the bridge. Such a monolithic construction can save costs in required materials and time in engaging the multiple portions together.

Although FIG. 3 depicts the bridge portions 171, 172 hinging downwardly relative to each other along the bridge hinge area 175, in other embodiments, the bridge portions can have a differing hinge orientation. For example, in alternative embodiments, the bridge portions can hinge upward relative to each other along the bridge hinge area.

The bridge 170 defines wall hinge areas 173, 174 defined between the bridge 170 and the wall portions 110, 140 to allow for the wall portions 110, 140 to hinge relative to the bridge 170. In particular, the first bridge portion 171 can hinge relative to the first wall portion 110 along the first wall hinge area 173 and the second bridge portion 172 can hinge relative to the second wall portion 140 along the second wall hinge area 174. Wall hinge areas 173, 174 can be a fold line formed between the bridge 170 and the wall portions 110, 140, such as through a pressure indentation or as perforations.

In some embodiments, the bridge 170 is located along a center line of the bag expander 100 defined between edges 102, 103 in one direction (e.g., the length of the bag expander 100) and below a center line defined by the bag expander 100 between edges 101, 104 along an opposing direction (e.g., the width of the bag expander 100). In some embodiments, the bridge can be centered in both directions.

In some embodiments, the bag expander 100 is configured in implementation to allow for each wall portion 110, 140 to be able to rotate more than 90, 180 and 270 degrees about hinge areas 173, 174. For example, as shown, there is only one bridge 170, and the position and structure of the bridge 170 relative to the wall portions 110, 140 is adapted to allow the wall portions 110, 140 to have a wide range of rotation. As a matter of clarification, in some known prior art, the bag expander is configured to have an arrangement that provides distributed pressure on the wall portions and, at the same time, limits the flexibility of the expander from having different shapes such as being able substantially flat (when the wall are rotated to be substantially coplanar). In a yet further alternative, there can be more than one bridge (or other member) extending between the wall portions. For example, there may be another bridge cut from a top edge of the wall portions to provide a greater expansion force.

Figure 5:
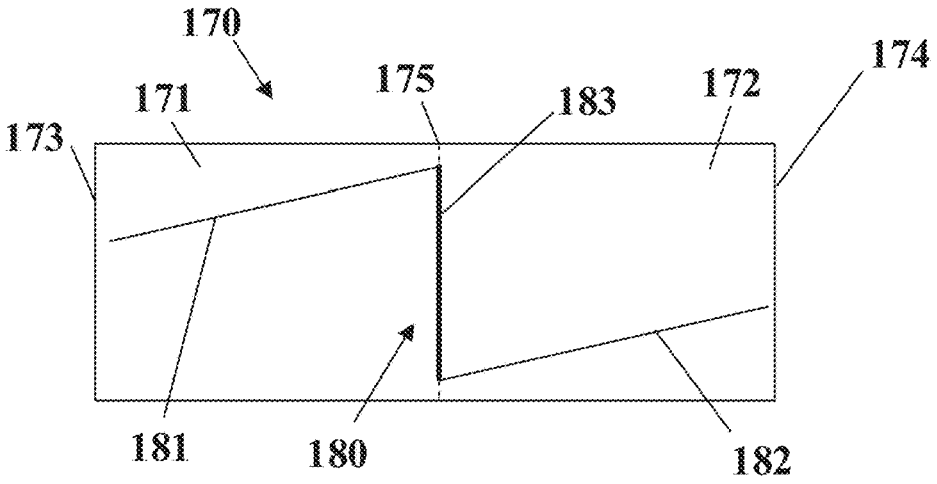
FIG. 5 is a top view of the bridge of the bag expander of FIG. 1 without the tape on the bridge.
Figure 6:
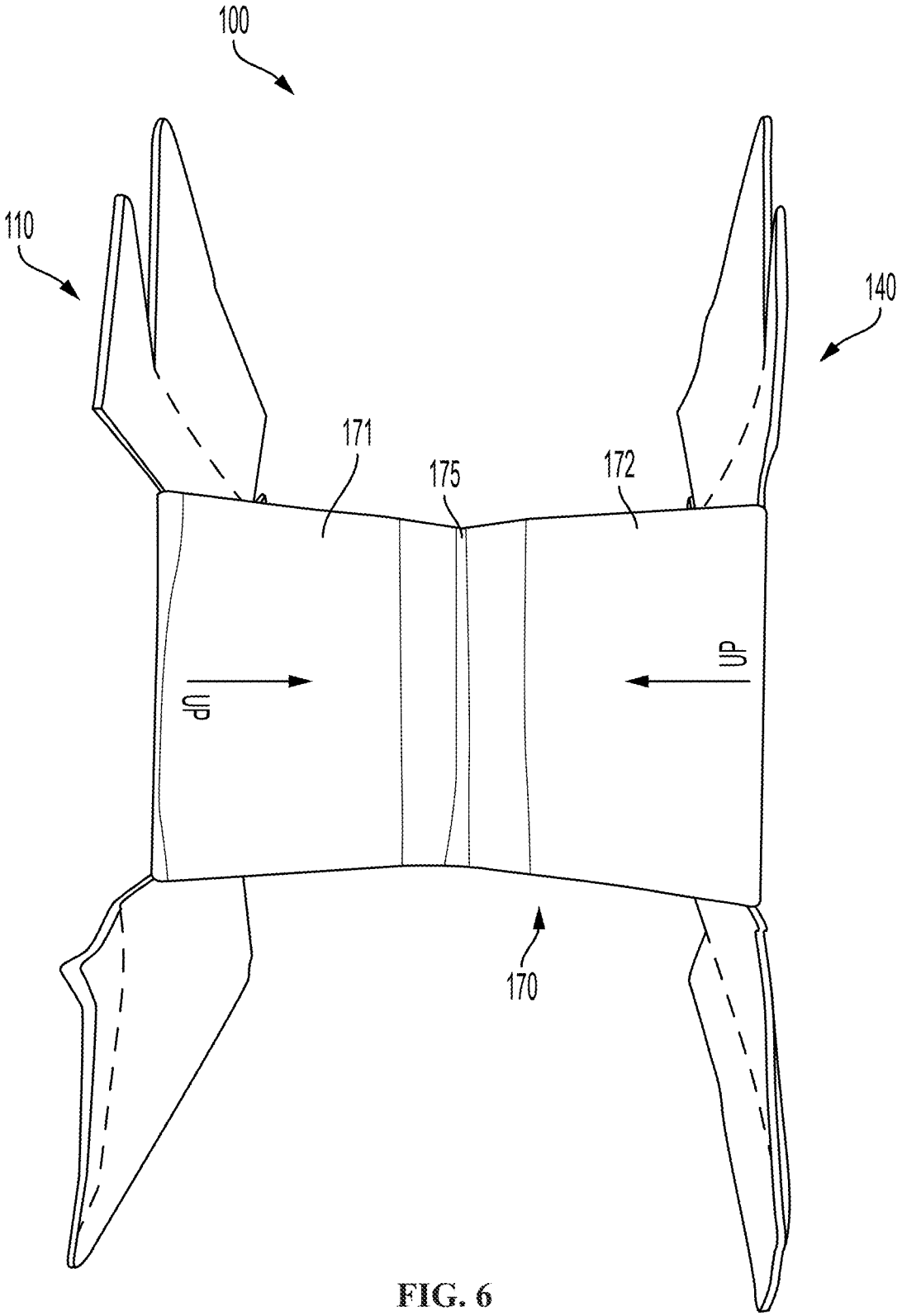
FIG. 6 is a bottom view of the bag expander of FIG. 1.

FIG. 4 depicts the bag expander 100 including an expansion mechanism 180 secured to a top surface of the bridge 170 through a tape 190. However, in other embodiments, the expansion mechanism can be engaged to the bridge using glue, a mechanical engagement (e.g., a latching system), or the like. To better understand the structure of the bridge 170, FIG. 5 depicts a top view of the expansion mechanism 180 engaged to the bridge 170 with the tape 190 removed. The expansion mechanism 180 can be a torsion spring (e.g., having a Z-shape), however other expansion mechanisms can be used, such as a flat spring or the like. In other embodiments, the expansion mechanism can be engaged to the bridge through other means, such as with glue or the like. In yet other embodiments, the expansion mechanism can be engaged along a bottom surface of the bridge, as shown in FIG. 22 and discussed further below.

The expansion mechanism 180 includes a central portion 183 and legs 181, 182 extending from the central portion 183. The central portion 183 provides a constant biasing force to rotate the legs 181, 182 away from each other about the central portion 183 when the distal ends of the legs 181, 182 (the portions of the legs 181, 182 furthest away from the central portion 183) are less than a pre-set distance away from each other (the pre-set distance being controlled by, or based on the position and structure of the biasing mechanism). The central portion 183 can be aligned and secured with the bridge hinge area 175 while the first leg 181 can be secured to the first bridge portion 171 and the second leg 182 can be secured to the second bridge portion 172. In this manner, the bridge portions 171, 172 can be biased away from each other about the bridge hinge area 175 through the engagement of the expansion mechanism 180 to the bridge 170 such that the wall portions 110, 140 are correspondingly biased away from each other. Such a pre-set distance can be customized to set a maximal biasing distance as desired by an end user. In particular, the bag expander 100 is configured to establish a pre-set distance by way of the distance at the connection point where the bridge 170 is attached to the wall portions (e.g., hinge areas 173, 174). In some embodiments, for example, the wall portions of the bag expander may bend when the bag expander is expanded, or may not necessarily be fully parallel, based on the shape of the bag in which the bag expander is being used.

The expansion mechanism 180 can for example be adapted to only be biased in one direction. For example, the expansion mechanism can be a spring configured to push out when the spring arms are pushed towards each other. The spring is adapted for that operation, and it can have some bias in the opposite direction, but it is typically of a lesser torque or pressure.

FIGS. 7-10 depict the bag expander 100 inserted within a housing of a bag article 10 in both a collapsed and expanded configuration. In particular, FIGS. 7 and 9 depict the bag expander 100 in a compressed configuration, and FIGS. 8 and 10 depict the bag expander 100 in an expanded configuration.

With reference to FIGS. 7 and 9, the bag expander 100 is in a collapsed configuration inside bag article 10. The wall portions 110, 140 are close to each other such that the wall portions 110, 140 are less than a pre-set distance away from each other and the bag article 10 does not have an expanded appearance. In this configuration, the legs 181, 182 of the expansion mechanism 180 are engaged to the bridge portions 171, 172 to provide a constant biasing force to rotate bridge portions 171, 172 away from each other about the bridge hinge area 175 and, by extension, to push the wall portions 110, 140 away from each other through the engagement of the wall portions 110, 140 to bridge portions 171, 172 along their respective engagement to hinge areas 173, 174. In this collapsed configuration, a plurality of bag articles 10 and collapsed bag expanders 100 can be easily transported without taking up much space.

With reference to FIGS. 8 and 10, the bag expander 100 is in an expanded configuration inside bag article 10. The wall portions 110, 140 are farther from each other in the expanded configuration than in the collapsed configuration to provide the bag article 10 with an expanded appearance. In particular, the most distal tips of the legs 181, 182 of the expansion mechanism 180, the bridge portions 171, 172, and the wall portions 110, 140 are biased away from each other a greater distance than in the collapsed configuration. Further, the angle between the wall portions 110, 140 and the bridge portions 171, 172, and the angle between the bridge portions 171, 172 are greater in the expanded configuration than the corresponding angles between these structures in the collapsed configuration. The wall portions 110, 140 abuts against the adjacent inner surface of the housing of the bag article 10 to give the bag article 10 a filled appearance.

During the expansion, the portions 121, 122, 123, 124, 125 of the first wall portion 110 can hinge about the foldable areas 111, 112, 113, 114, 115 as they abut against a portion of the bag article 10 that does not have a non-planar surface. For example, FIGS. 8 and 10 depict the bag article 10 to have a curved surface along the portions abutting against the first wall portion 110 such that the portions 121, 122, 123, 124, 125 can hinge about the foldable areas 111, 112, 113, 114, 115 to conform to the shape of the bag article 10. In other examples, depending on the shape of the bag article, portions of both the first and second wall portion can hinge to conform to the shape of the bag article, or neither of the wall portions have portions that hinge.

In operation, for example, the portions 121, 122, 123, 124, 125 are flat (e.g., parallel with respect to each other) when the bag expander 100 is inserted into the bag article 10 before the bag article 10 is wrapped for transportation. When the wrapping or enclosure of the bag article 10 is removed, pressure is (automatically) applied by the interior surfaces of the bag articles 10 to the wall portions 110, 140 when the expander is expanded. The force can then, due to the pressure, bend portions 121, 122, 123, 124, 125 to each other and/or to the main portion 130 at the foldable areas 111, 112, 113, 114, 115 in a planned or predefined way (e.g., as opposed to wall bending in an uneven way without a preexisting crease). The cooperation of the multiple adjacent foldable areas 111, 112, 113, 114, 115 and the shape of the portions 121, 122, 123, 124, 125 can together, for example, allow for a cardboard to generate a surface that appears to have a curved wall to the interior wall of the bag article 10 from the interior surface of the bag article 10. If desired, in some embodiments, the foldable areas (e.g., a crease) provides the opportunity to easily trim or adapt the shape of the expander before it is inserted into a bag. As a matter of clarification, the general operation for the use of the bag expander is that the bag expander in a collapsed configuration is placed in a bag article, and that assembly is placed in a container (e.g., a plastic bag) or wrapped to adapt the shape of the assembly to be flat for shipment. If wrapped, such as with plastic wrap, it is shipped to a store and, at the store, the retailer can simply cut the wrap and the bag expander can automatically expand the bag article to provide a display ready appearance.

FIGS. 11-12 depict the bag expander 100 in an unassembled configuration. In this configuration, the wall portions 110, 140 have been rotated about the bridge 170 along hinge areas 173, 174 such that the wall portions 110, 140 lie substantially along the same plane. In particular, the wall portions 110, 140 can be rotated about the bridge 170 to lay flat along a same plane (e.g., when laid on a flat top surface) at the same time and while the wall portions 110, 140 and bridge 170 are engaged to each other. Further, the substantially planar relationship of the wall portions 110, 140 can exist while the wall portions 110, 140 and bridge 170 are monolithic (e.g., formed as one piece) with each other. Such a monolithic construction can save costs in required materials and time in engaging the multiple portions together. In this manner, unassembled bag expanders can be stacked together to allow for easier transportation of a plurality of bag expanders.

For explanation purposes, with respect to the rotation of the walls portions, at least one wall portion and, as shown in FIGS. 1-6, both wall portions, are adapted to rotate about 90 and about 270 degrees in one direction (e.g., such that a top edge 101 of the first wall portion 110 is rotated away from the second wall portion 140 to achieve 90 degrees of rotation and then toward the second wall portion 140 to achieve 270 degrees of rotation) relative to their position in the compressed configuration (e.g., as shown in FIG. 7). Attempting to rotate the wall portion in the opposite direction, for example, would result in the rotation of one wall portion would be blocked by the opposing wall portion.

Another potential advantage is that the bag expander can also be folded for shipping (as an alternative approach) by, for example, when the bag expander is in an unassembled configuration, rotating one of the wall portions (e.g., the first wall portion) 180 degrees about the hinge areas defined between the bridge and the first wall portion. The first wall portion would then lay below the bridge and the second wall portion after the first wall portion is rotated. In this position, the bridge can be oriented such that the bridge is angled upwards due to the biasing force of the expansion mechanism, such as the bridge 170 as shown in FIG. 12. In this orientation, the bridge can be pressed down with ease to lay flat.

FIGS. 13-16 depict example bag expanders 200, 300, 400 having a similar structure to the bag expander 100, such that the reference numerals used for the bag expanders 200, 300, 400 having like trailing numbers as the reference numerals used for the bag expander 100 reference similar structures, except as discussed below.

Figure 13:
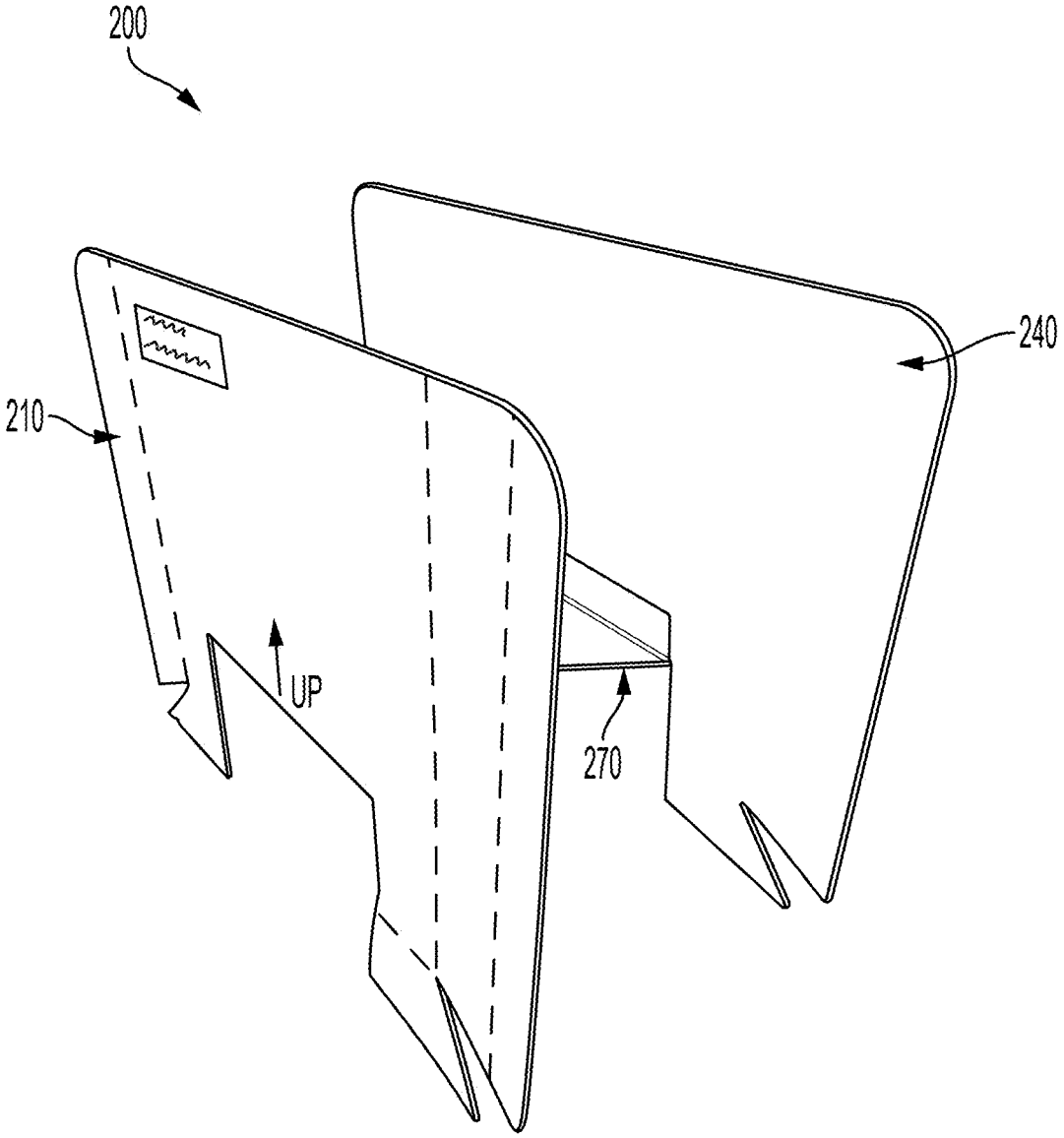
FIG. 13 is a top perspective view of a bag expander according to another aspect of the disclosure.
Figure 14:
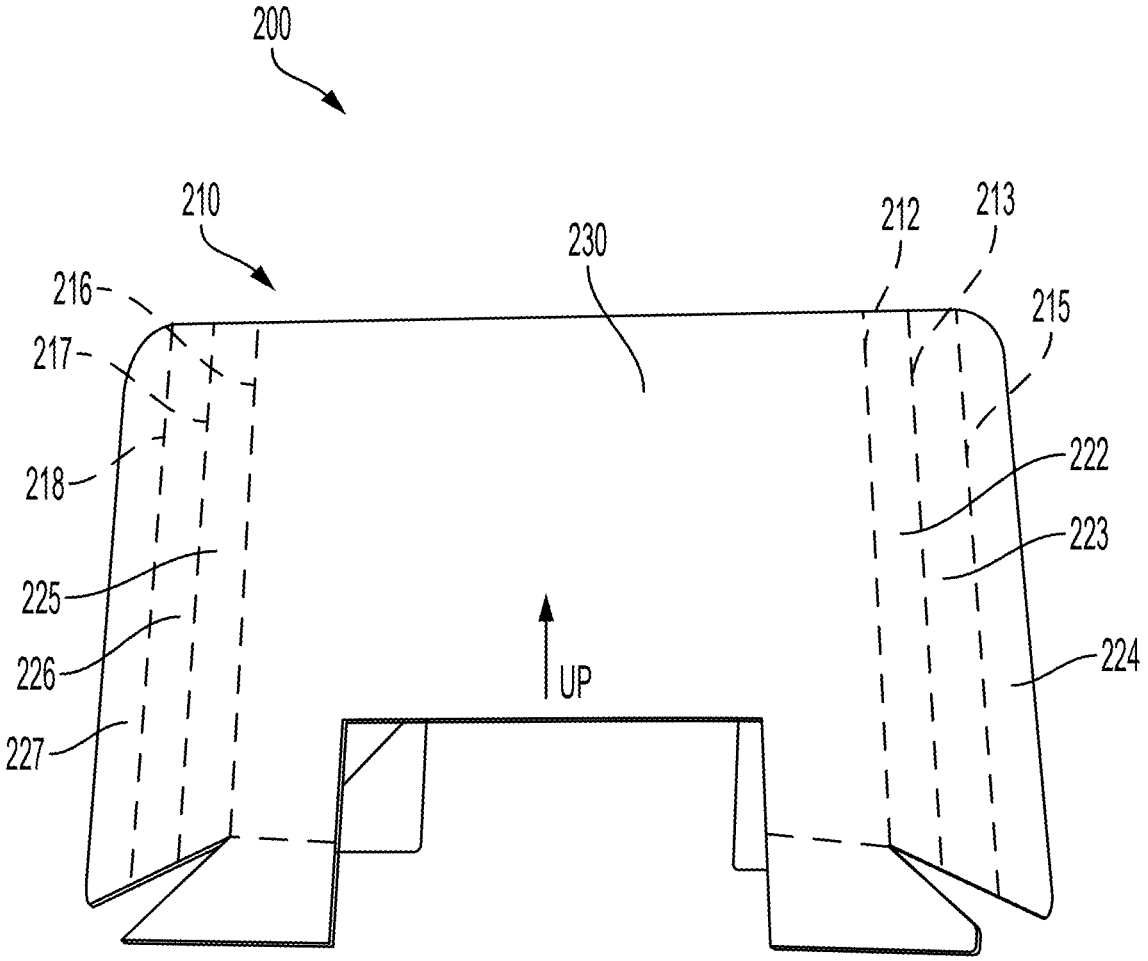
FIG. 14 is a front view of the bag expander of FIG. 13.

FIGS. 13-14 depict the bag expander 200 having a first wall portion 210, second wall portion 240, and a bridge 270.

The first wall portion 210 includes a main portion 230 and side portions 222, 223, 224, 225, 226, 227, and defines foldable areas 212, 213, 215, 216, 217, 218. The side portions 222, 223, 224, 225, 226, 227 can rotate with respect to either each other or the main portion 230 by folding about the foldable areas 212, 213, 215, 216, 217, 218 to better conform to the shape of a bag article during the expansion process.

Figure 15:
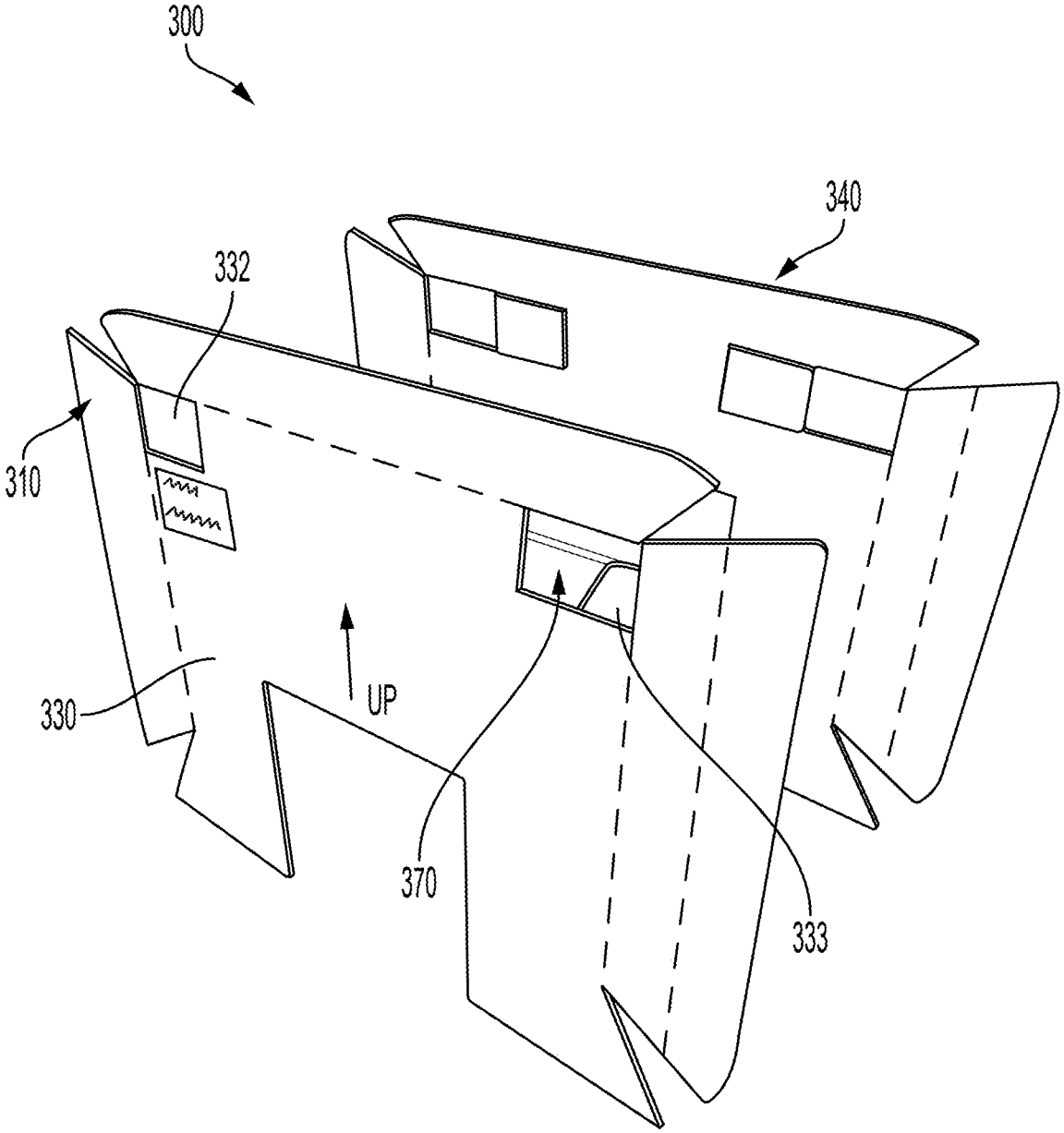
FIG. 15 is a top perspective view of a bag expander according to another aspect of the disclosure.

FIG. 15 depicts the bag expander 300 having a first wall portion 310, a second wall portion 340, and a bridge 370. The first wall portion 310 includes a main portion 330 defining cutouts 332, 333. Each of the cutouts 332, 333 can be configured to receive an object to assist in stabilizing the bag expander 300 during expansion of the bag expander when the bag expander 300 is inserted in a bag article. In this manner, the object received through the cutouts 332, 333 can allow for the wall portions 310, 340 to expand from each other in a more uniform fashion so that one of the wall portions 310, 340 does not expand from at an angle to the other. Additionally or alternatively, the cutouts 323, 333 can further facilitate a change in size of structure of the first wall portion 310 if portions of the first wall portion 310 are separated from each other along the perforation lines adjacent the cutouts 323, 333.

Figure 16:
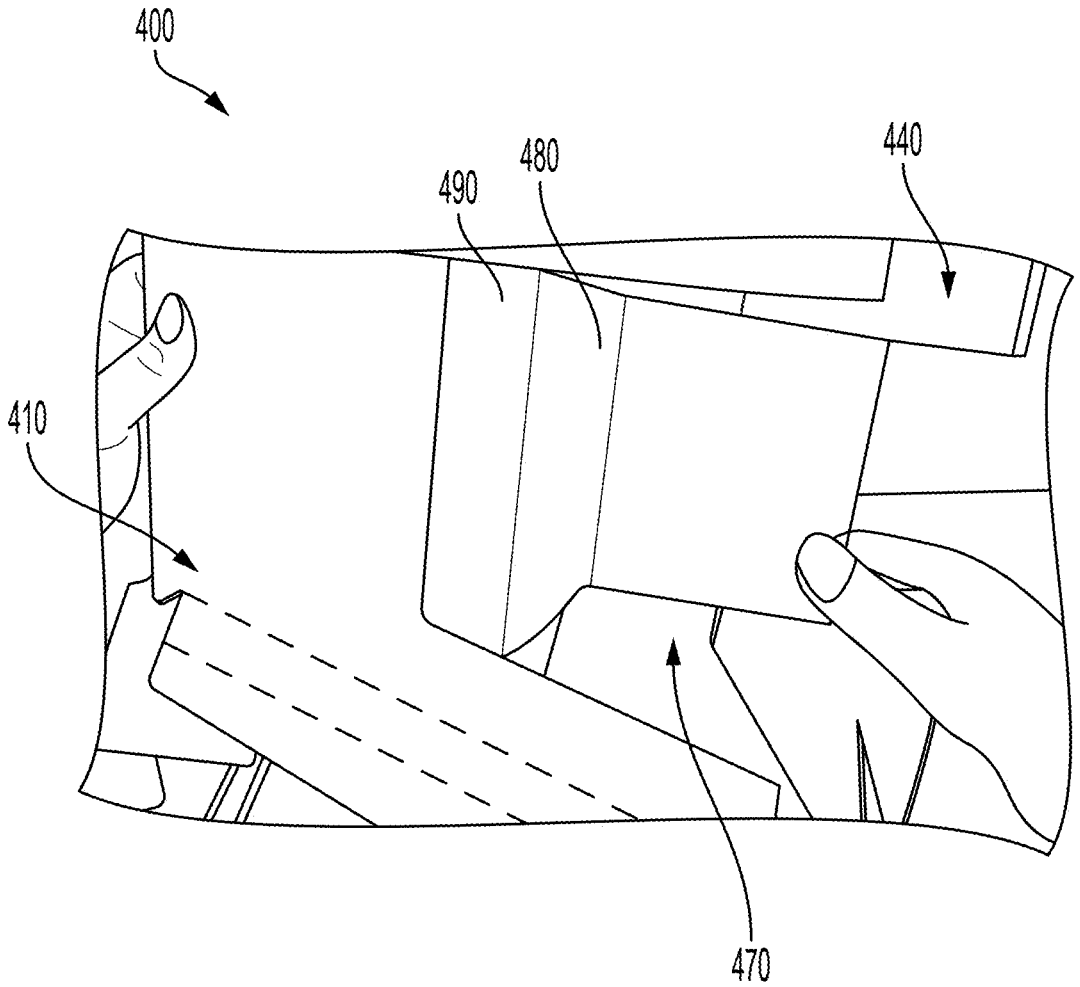
FIG. 16 depicts a bottom perspective view of a bag expander according to another aspect of the disclosure.

FIG. 16 depicts the bag expander 400 having a first wall portion 410, a second wall portion 440, and a bridge 470. The bridge 470 includes an expansion mechanism 480 secured to a bottom surface of the bridge 470 using tape 490.

Figure 17:
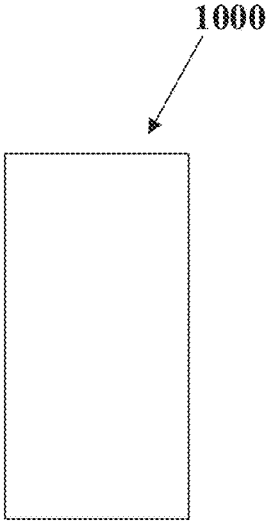
FIGS. 17-21 are a top view of a process of manufacturing the bag expander of FIGS. 1-6 according to another aspect of the disclosure.

FIGS. 17-22 depicts the process of manufacturing the bag expander 100. However, a similar method of manufacturing can manufacture the bag expanders 200, 300. With reference to FIG. 17, a blank 1000 is received by a manufacturing system. The manufacturing system includes a cutting mechanism, such as a die cutter, a roller with blades projecting therefrom, or the like. The cutting mechanism can be configured to cut the shape of the bag expander 100.

Figure 18:
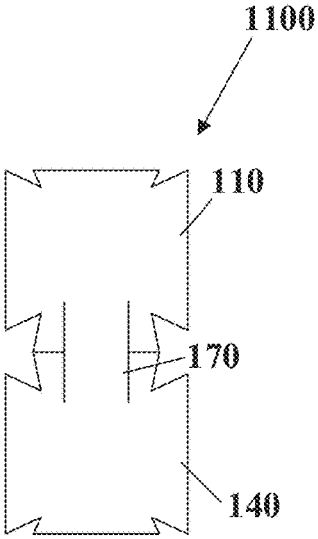

With reference to FIG. 18, the cutting mechanism can cut the outline of the bag expander 100 into blank 1000 to form a cut blank 1100. Cut blank 1100 includes wall portions 110, 140 and bridge 170 such that the wall portions 110, 140 and bridge 170 are monolithic to each other. The cutting mechanism can also cut perforations onto the cut blank, such as the foldable areas 111, 112, 113, 114, 115, shown in FIG. 2. Each cut blank 1100 is separated from adjacent cut blanks as they are cut from a blank. However, in other embodiments, each cut blank can maintain contact with adjacent cut blanks during the manufacturing process. Further, in other embodiments, the cutting mechanism can cut the wall portions and bridge into separate pieces for later engagement.

Figure 19:
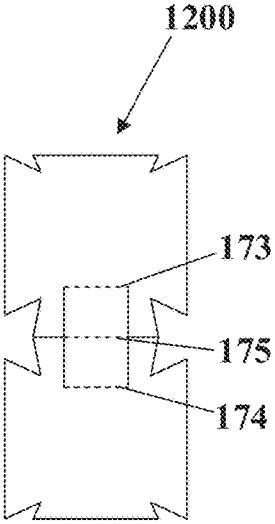

With reference to FIG. 19, a pressing mechanism can form hinge areas 173, 174, 175 along the cut blank 1100 to form a pressed blank 1200. For example, the pressing mechanism can indent portions of the cut blank 1100 to form hinge areas 173, 174, 175. In other examples, the pressing mechanism can include a mold such that the cut blank 1100 can be pressed against the mold to form hinge areas. In alternative embodiments, the hinge areas can be formed by a cutting mechanism cutting a set of perforations along the hinge areas rather than using a pressing mechanism.

Figure 20:
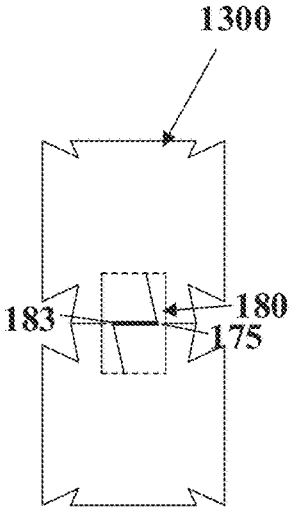

With reference to FIG. 20, the manufacturing system can place an expansion mechanism 180 along the bridge 170 such that a center portion 183 of the expansion mechanism 180 can be aligned with the bridge hinge area 175 to form an unsecured blank 1300.

Figure 21:
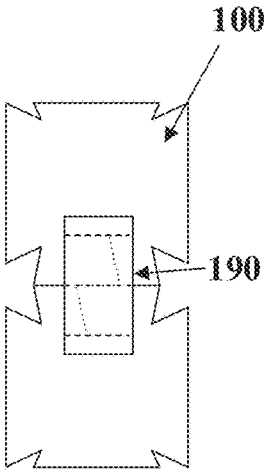

With reference to FIG. 21, the manufacturing system can secure the expansion mechanism 180 to the bridge 170 by overlaying tape 190 onto the expansion mechanism 180 and the bridge 170 to form the bag expander 100 in an unassembled configuration. However, in alternative embodiments, the manufacturing system can secure the expansion mechanism to the bridge with glue or the like.

As the bag expander 100 in an unassembled configuration is substantially planar, it allows for multiple bag expanders to be easily stacked together in a condensed formation for easier transportation of a large quantity of bag expanders. For example, with reference to FIG. 22, the bag expander 100 is stacked with other bag expanders to form a stack 1400 of bag expanders 100 to be secured and transported to an end user. As shown, the bridge 170 can be angled to provide a potential self-alignment features for stacking the bag expanders when they are manufactured by allowing for a bridge of one bag expander stack onto the bridge of the next bag expander. This self-alignment feature can be a product of the expansion mechanism pulling the wall portions together while the bag expander is in an unassembled configuration. For example, with reference to FIGS. 4-5, the pre-set distance between the distal ends of the legs 181, 182 can bias the legs to that distance, and pull the wall portions 110, 140 together such that the bridge 170 forms an angled self-alignment feature.

Although the method of manufacturing is disclosed as occurring sequentially, one or more steps can occur in a different order or simultaneously. For example, the steps of forming the hinge areas 173, 174, 175, placing the expansion mechanism 180 on the bridge 170, and securing the expansion mechanism 180 to the bridge 170 as shown in FIGS. 19-21 can be performed simultaneously. Further, although the wall portions and bridge are described as being cut from a blank to be monolithic, in other embodiments, the wall portions can be distinct pieces engaged to each other through glue, tape, stapling, or the like. For example, the bridge can be made of two bridge portions that are engaged along an edge to define a bridge hinge, or at least one of the wall portions are made separate from the bridge and the other wall portion.

The expansion mechanism refers to the mechanism integrated into the structure that applies a load when the expander is in an assembled or collapsed state such that that when the bag is removed the enclosure or wrap, the load pushes the walls apart to "fill" the bag. It can involve a spring such as one or more springs. It can use other devices. As shown, a single type of spring is positioned at a location on the bridge which provides a simple solution for implementation that can have cost and operational benefits. A mechanism such as the spring can be located in other locations or combination of mechanism (e.g. two springs) can be located in other locations to provide the functional operation.

Although the disclosure herein has been described with reference to particular aspects, it is to be understood that these aspects are merely illustrative of the principles and applications of the present disclosure. It is therefore to be understood that numerous modifications may be made to the illustrative aspects and that other arrangements may be devised without departing from the spirit and scope of the present disclosure as defined by the appended claims.

What is claimed is:

1. A bag expander, comprising:

a first wall portion;

a second wall portion;

a bridge having a torsion spring secured by an overlaying tape positioned on a top surface of the bridge, and the bridge coupling the first and second wall portions together, wherein the first and second wall portions are rotatable about the bridge to lie along a substantially same plane such that the bridge of the bag expander is configured to receive a bridge of another bag expander of the same kind when stacked together, wherein the secured torsion spring is configured to bias the first wall and second wall portions from a collapsed configuration to an expanded configuration, wherein in the collapsed configuration, the top surface of the bridge face toward the first wall portion and the second wall portion, and wherein the bridge includes a first and second portion, and defines a hinge area, the first portion being rotatable to the second portion along the hinge area, and wherein the torsion spring has a central portion engaged to the hinge area.

2. The bag expander of claim 1, wherein:

the first and second portions rotate about a first axis; and at least one of the first and second wall portions rotate about a second axis substantially parallel to the first axis.

3. The bag expander of claim 1, wherein the bridge is single paneled, monolithic and is connected to the first and second wall portions by a hinge area only, respectively.

4. The bag expander of claim 1, wherein the first and second wall portions and the bridge are monolithic.

5. The bag expander of claim 1, wherein at least one of the first and second wall portions define a foldable area such that at least a portion of the at least one of the first and second wall portions can be folded to define an edge along the foldable area.

6. The bag expander of claim 5, wherein the at least one of the first and second wall portions includes a line of perforations, the foldable area being defined by the line of perforations.

7. A bag article, comprising:

a housing; and the bag expander of claim 1 received in the housing.

8. A bag expander, comprising:

a first wall portion;

a second wall portion;

a bridge coupling the first and second wall portions together, wherein the first and second wall portions can hinge about the bridge to lie along a substantially same plane such that the bridge of the bag expander is configured to receive a bridge of another bag expander of the same kind when stacked together; and an expansion mechanism secured to the bridge, wherein:

in a collapsed configuration, the first and second wall portions are a first distance from each other, and in an expanded configuration, the first and second wall portions are a second distance from each other, the second distance being greater than the first distance, wherein the expansion mechanism is secured by an overlaying tape, and wherein the bridge includes a first and second portion, and defines a hinge area, the first portion being rotatable to the second portion along the hinge area, and wherein the expansion mechanism has a central portion engaged to the hinge area.

9. The bag expander of claim 8, wherein:

the first and second portions rotate about a first axis; and at least one of the first and second wall portions rotate about a second axis substantially parallel to the first axis.

10. The bag expander of claim 8, wherein the bridge is single paneled, monolithic and is connected to the first and second wall portions by a hinge area only, respectively.

11. The bag expander of claim 8, wherein the first and second wall portions and the bridge are monolithic.

12. The bag expander of claim 8, wherein at least one of the first and second wall portions define a foldable area such that at least a portion of the at least one of the first and second wall portions can be folded to define an edge along the foldable area.

13. The bag expander of claim 12, wherein the at least one of the first and second wall portions includes a line of perforations, the foldable area being defined by the line of perforations.

14. A bag article, comprising:

a housing; and the bag expander of claim 8 received in the housing.

* * * * *